US008210523B2

(12) United States Patent
Maekawa et al.

(10) Patent No.: US 8,210,523 B2
(45) Date of Patent: Jul. 3, 2012

(54) PAPER SHEET HOLDING APPARATUS

(75) Inventors: Kouichi Maekawa, Tokyo-To (JP); Osamu Ito, Kawaguchi (JP); Hidehiko Matsushita, Takasago (JP); Fumiaki Koga, Tokyo-To (JP)

(73) Assignee: Glory Ltd., Hyogo-Ken (JP)

( * ) Notice: Subject to any disclaimer, the term of this patent is extended or adjusted under 35 U.S.C. 154(b) by 286 days.

(21) Appl. No.: 12/449,203

(22) PCT Filed: Feb. 8, 2007

(86) PCT No.: PCT/JP2007/052188

§ 371 (c)(1),
(2), (4) Date: Jul. 28, 2009

(87) PCT Pub. No.: WO2008/096428

PCT Pub. Date: Aug. 14, 2008

(65) Prior Publication Data

US 2010/0117294 A1 May 13, 2010

(51) Int. Cl.
*B65H 1/08* (2006.01)

(52) U.S. Cl. ..... 271/126; 271/160; 271/165

(58) Field of Classification Search ..... 271/126, 271/157, 160, 165
See application file for complete search history.

(56) References Cited

U.S. PATENT DOCUMENTS 4,971,310 A * 11/1990 Motegi et al. ..... 271/126
5,967,504 A * 10/1999 Yankloski ..... 271/2

FOREIGN PATENT DOCUMENTS

| | | |
|---|---|---|
| JP | 63-88636 | 6/1988 |
| JP | 03-095033 | 4/1991 |
| JP | 2005-212910 | 8/2005 |
| JP | 2006-027776 | 2/2006 |

* cited by examiner

*Primary Examiner* — Kaitlin Joerger
(74) *Attorney, Agent, or Firm* — Renner, Kenner, Greive, Bobak, Taylor & Weber

(57) ABSTRACT

A paper sheet storage unit 101 is opened upward and forward. Holding members 30, 32 are respectively configured to be reciprocated, between a waiting position and a holding position, by a lifting and lowering mechanism 35. When the respective holding members 30, 32 are in the waiting position, such holding members 30, 32 can serve as a guide surface, on the back side of the paper sheet storage unit 101, for guiding a batch of paper sheets stored in the paper sheet storage unit 101. Meanwhile, when the respective holding members 30, 32 are in the holding position, the holding member 32 is in contact with a top face of the paper sheet present at the lowest layer of the paper sheets stored in the paper sheet storage unit 101, and serves to press the paper sheet downward. A controller 90 controls the lifting and lowering mechanism 35, such that the lifting and lowering mechanism 35 moves the holding members 30, 32 to the waiting position, when a paper sheet storage amount detector 74 detects that the amount of the paper sheets stored in the paper sheet storage unit 101 is greater than a preset amount, while the lifting and lowering mechanism 35 moves the holding members 30, 32 to the holding position, when the paper sheet storage amount detector 74 detects that the amount of the paper sheets stored in the paper sheet storage unit 101 is less than the preset amount.

14 Claims, 7 Drawing Sheets

PAPER SHEET HOLDING APPARATUS

FIELD OF THE INVENTION

The present invention relates to a paper sheet holding apparatus having a holding member adapted for holding, from above, a plurality of paper sheets stored, in a stacked condition, in a paper sheet storage unit, and in particular relates to the paper sheet holding apparatus, which can facilitate replenishment work for the paper sheets to the paper sheet storage unit, wherein the holding member can be automatically moved to a waiting position when the amount of the paper sheets stored in the paper sheet storage unit is greater than a preset amount, thereby enabling additional replenishment of the paper sheets freely.

BACKGROUND OF THE INVENTION

Conventionally, a banknote handling machine, which can sort the banknotes deposited from a customer, for each denomination thereof, and then store them therein, has been known. In such a banknote handling machine, upon the deposition of the banknotes into the machine, the banknotes are first received in a hopper. Then, the banknotes received in the hopper in a stacked condition are fed to the interior of the banknote handling machine, one by one. In this case, if the banknotes received in the hopper are folded and creased, some problems, such as a jam or the like, are likely to occur, when such banknotes are fed into the banknote handling machine. Thus, in order to prevent the banknotes from being folded, a banknote holding apparatus is used for holding, from above, the banknote present at the highest layer of a batch of the banknotes stored in the hopper (see, e.g., Japanese Utility Model No. 6-1544).

In the conventional banknote holding apparatus as disclosed in the above Japanese Utility Model No. 6-1544 or the like, a banknote holding plate is provided just above a table of the hopper for placing the banknotes thereon. Therefore, when the banknotes are replenished into the hopper, a user of the apparatus can place the banknotes on the table of the hopper only from the front of the apparatus. Accordingly, in such an apparatus, the replenishment work for the banknotes to the hopper may tend to be troublesome. Besides, such a conventional banknote holding plate has been detected at only two points, i.e., an upper limit position of the banknote holding plate (e.g., a waiting position of the banknote holding plate, for the replenishment of the banknotes) and a lower limit position thereof (e.g., a position, in which the last one banknote stored in the hopper is fed out). This makes it difficult to additionally replenish the banknotes into the hopper.

The present invention was made in light of the above problems. Therefore, it is an object of the present invention to provide a paper sheet holding apparatus, which can facilitate the replenishment work for the paper sheets into the paper sheet storage unit, by enabling the replenishment of the paper sheets into the paper sheet storage unit to be performed, not only from the front but also from above, and which can optionally perform the additional replenishment of the paper sheets, by allowing the holding member to be automatically moved to the waiting position, when the amount of the paper sheets stored in the paper sheet storage unit is greater than the preset amount.

DISCLOSURE OF THE INVENTION

A paper sheet holding apparatus of the present invention comprises: a paper sheet storage unit opened at least upward and forward and adapted for storing therein a plurality of paper sheets in a stacked condition; a paper sheet feeding mechanism located below the paper sheet storage unit and adapted for feeding each paper sheet present at the lowest layer of the plurality of paper sheets stored in the paper sheet storage unit, one by one, to the outside of the paper sheet storage unit; a holding member, which is adapted for holding, from above, a batch of the paper sheets stored, in the stacked condition, in the paper sheet storage unit, and which is configured to be optionally reciprocated between a waiting position and a holding position, so that the holding member can serve as a guide surface for guiding the batch of the paper sheets stored in the paper sheet storage unit, on the back side opposite to the front of the paper sheet storage unit, when the holding member is in the waiting position, while the holding member can be in contact with a top face of the paper sheet present at the highest layer of the batch of the paper sheets stored in the paper sheet storage unit and serve to press the paper sheet downward, when the holding member is in the holding position; a lifting and lowering mechanism adapted for reciprocating the holding member between the waiting position and the holding position; a paper sheet storage amount detector adapted for detecting that an amount of the paper sheets stored in the paper sheet storage unit is greater than a preset amount; and a controller adapted for controlling the lifting and lowering mechanism, such that the lifting and lowering mechanism moves the holding member to the waiting position, when the paper sheet storage amount detector detects that the amount of the paper sheets stored in the paper sheet storage unit is greater than the preset amount, while the lifting and lowering mechanism moves the holding member to the holding position, when the paper sheet storage amount detector detects that the amount of the paper sheets stored in the paper sheet storage unit is less than the preset amount.

According to the above paper sheet holding apparatus, the paper sheet storage unit is opened upward and forward, and the holding member can serve as the guide surface, on the back side of the paper sheet storage unit, for guiding the batch of the paper sheets stored in the paper sheet storage unit, when the holding member is in the waiting position. Thus, upon replenishment of the paper sheets into the paper sheet holding unit, a user can replenish the batch of the paper sheets into the paper sheet storage unit, not only from the front but also from above. This can significantly facilitate the replenishment work for the paper sheets. In addition, the paper sheet storage amount detector is provided, such that the holding member is automatically moved to the waiting position, when the amount of the paper sheets stored in the paper sheet storage unit is greater than the preset amount. This configuration can prevent the paper sheet present at the lowest layer from being undesirably folded and creased, by utilizing the weight of the batch of the paper sheets stored in the paper sheet storage unit, while enabling additional replenishment of the paper sheets freely.

In the paper sheet holding apparatus of the present invention, it is preferred that the holding member has a guide plate that can be used as the guide surface, when the holding member is in the waiting position, the position of the guide plate, when the holding member is in the waiting position, being on the back side of the paper sheet storage unit with respect to and higher than the position of the guide plate, when the holding member is in the holding position, wherein the holding member is moved to gradually increase an angle of the guide plate relative to a bottom face of the paper sheet storage unit, as the lifting and lowering mechanism moves the holding member from the holding position to the waiting position. With this configuration, when the holding member is in the waiting position, a lower portion of the guide plate is retracted toward the back side of the paper sheet storage unit, so that the guide plate can be used as a proper guide surface. Meanwhile, when the holding member is in the holding position, the lower portion of the guide plate is advanced toward the front of the paper sheet storage unit, so that the holding member can be adequately contacted with the top face of the paper sheet present at the highest layer of the batch of the paper sheets stored in the paper sheet storage unit.

Preferably, the paper sheet storage amount detector is composed of an optical sensor, the optical sensor being provided in such a position that light horizontally emitted from the optical sensor can travel outside a region in which the holding member is moved between the waiting position and the holding position, wherein the controller controls the lifting and lowering mechanism to move the holding member to the waiting position, when the light horizontally emitted from the optical sensor is blocked by the paper sheets stored in the paper sheet storage unit. With such configuration, when the user wants to replenish the paper sheets, by hand, into the paper sheet storage unit, after a part or all of the paper sheets stored in the paper sheet storage unit were fed out by the paper sheet feeding mechanism, the user can move the holding member from the holding position to the waiting position, by blocking the light emitted from the optical sensor of the paper sheet storage amount detector, by using the batch of the banknotes that the user holds or by using the user's hand itself, without pushing, for example, a holding member lift-up button, provided to the paper sheet holding apparatus. In this case, since the user can operate the holding member without pushing the holding member lift-up button or the like means, the operation of the paper sheet holding apparatus can be significantly facilitated. More preferably, the optical sensor is located at a height within a range of 50 to 70 mm from the bottom face of the paper sheet storage unit. For instance, when the height of the batch of the paper sheets stored in the paper sheet storage unit is higher than 50 mm, such an amount of the paper sheets can be considered to be sufficient for preventing the paper sheet present at the lowest layer from being unduly creased. In other words, the weight of the batch itself of the paper sheets loaded, in such a sufficient amount, on the lowest paper sheet can adequately serve to prevent occurrence of any creases therein. Therefore, with such an amount, the paper sheets can be smoothly fed out, even in the case in which the batch of the paper sheets stored in the paper sheet storage unit is not pressed, from above, by the holding member. For this reason, when the optical sensor of the paper sheet storage amount detector detects that the amount of the paper sheets stored in the paper sheet storage unit is greater than the preset amount, the holding member will be kept in the waiting position. It should be appreciated that the entire body of the paper sheet holding apparatus can be made significantly compact because the optical sensor of the paper sheet storage amount detector is located at the height of 70 mm or less from the bottom face of the paper sheet storage unit.

In the paper sheet holding apparatus of the present invention, it is preferred that a holding member lift-up button is further provided, wherein the controller controls the lifting and lowering mechanism to move the holding member to the waiting position, when the holding member lift-up button is pushed. With the provision of such a holding member lift-up button, the user can replenish the paper sheets by moving the holding member to the waiting position, when the user knows considerable reduction of the amount of the paper sheets stored in the paper sheet storage unit, from observation of the amount thereof.

More preferably, a paper sheet storage condition detector adapted for detecting that the paper sheets are stored in the paper sheet storage unit, and a holding position detector adapted for detecting that the holding member is in the holding position are further provided, respectively, wherein the controller stops operation of the paper sheet feeding mechanism, when the holding member lift-up button is pushed, and then restarts the operation of the paper sheet feeding mechanism, when the paper sheet storage amount detector detects that the amount of the paper sheets stored in the paper sheet storage unit is greater than the preset amount, or when the paper sheet storage condition detector detects that the paper sheets are stored in the paper sheet storage unit, while the holding position detector detects that the holding member is in the holding position. With such control performed by the controller, the operation of the paper sheet feeding mechanism can be stopped, when there is a possibility that the paper sheet present at the lowest layer of the paper sheets stored in the paper sheet storage unit may be creased, and then the operation of the paper sheet feeding mechanism can be restarted, when a state, in which the paper sheet present at the lowest layer is adequately held and pressed from above and thus it will not be folded and creased, can be obtained. Therefore, occurrence of some failure upon the feeding operation performed by the paper sheet feeding mechanism can be prevented.

Preferably, a paper sheet feed detector adapted for detecting that some failure occurs in the feeding operation for the paper sheets performed by the paper sheet feeding mechanism is further provided, wherein, when the holding member lift-up button is pushed, the controller changes a period of time required for the detection of the failure in the feeding operation due to the paper sheet feed detector, into a longer one than the period of time employed in a normal operation. Namely, when the amount of the paper sheets stored in the paper sheet storage unit is considerably reduced, the pressing force applied from above to the paper sheet present at the lowest layer should be reduced. Thus, in such a state, the paper sheet present at the lowest layer cannot be smoothly fed out by the paper sheet feeding mechanism. Therefore, if the period of time for the detection of the failure upon the feeding operation is kept unchanged relative to the normal operation, there is a risk that some failure may be detected mistakenly, even when no failure occurs, in fact, in the feeding operation performed by the paper sheet feeding mechanism, because of such a paper sheet present at the lowest layer that cannot be smoothly fed out by the paper sheet feeding mechanism. However, with proper change of the period of time for the detection of the failure upon the feeding operation into an adequately extended one, such a mistaken detection regarding failure in the feeding operation performed by the paper sheet feeding mechanism can be positively prevented.

In the paper sheet holding apparatus of the present invention, it is preferred that a lower edge of the holding member when the holding member is in the waiting position, and an upper edge of a lower side plate, which is on the back side of the paper sheet storage unit and located below the holding member while being adjacent to the lower edge of the holding member, when the holding member is in the waiting position, are respectively comb-shaped to be fitted relative to each other. With such configuration, when the holding member is in the waiting position, unexpected trouble such that some paper sheets stored in the paper sheet holding unit would accidentally get in a gap between the upper edge of the lower side plate on the back side of the paper sheet storage unit and the lower edge of the holding member, can be securely prevented.

More preferably, an upper edge of the holding member when the holding member is in the waiting position, and a lower edge of an upper side plate, which is on the back side of the paper sheet storage unit and located above the holding member while being adjacent to the upper edge of the holding member, when the holding member is in the waiting position, are respectively comb-shaped to be fitted relative to each other. With such configuration, when the holding member is in the waiting position, unexpected trouble such that some paper sheets stored in the paper sheet holding unit would accidentally get in a gap between the lower edge of the upper side plate on the back side of the paper sheet storage unit and the upper edge of the holding member, can be securely prevented.

More preferably, the lifting and lowering mechanism is configured, such that the holding member can be moved downward, by hand, relative to the upper side plate on the back side of the paper sheet storage unit, even when the holding member is in the waiting position. With such configuration of the lifting and lowering mechanism, the holding member can be moved downward relative to the upper side plate, even in the case in which a finger of the user is lodged between the holding member and the upper side plate on the back side of the paper sheet storage unit, while the holding member is moved toward the waiting position by the lifting and lowering mechanism. This can prevent such a lodged finger from being seriously damaged.

In the paper sheet holding apparatus of the present invention, it is preferred that the paper sheet feeding mechanism is composed of a kicker roller adapted for kicking each paper sheet present at the lowest layer of the plurality of paper sheets stored in the paper sheet storage unit, one by one, and a feed roller adapted for feeding the paper sheets kicked by the kicker roller, one by one, successively, to the outside of the paper sheet storage unit, wherein, when the holding member is in the holding position, each projection of the comb-shape of the lower edge of the holding member is located above the kicker roller of the paper sheet feeding mechanism. With such configuration, when the holding member is in the holding position, the batch of the paper sheets stored in the paper sheet storage unit can be adequately pressed between each projection of the comb-shape of the lower edge of the holding member and the kicker roller. Thus, when the paper sheets stored in the paper sheet storage unit are kicked out by the kicker roller of the paper sheet feeding mechanism, a portion of the paper sheet present at the lowest layer that will be in contact with the kicker roller can be directly pushed downward by the holding member, as such the kicking operation for the paper sheets can be securely performed by the kicker roller.

DETAILED DESCRIPTION OF THE INVENTION

Hereinafter, one embodiment of the present invention will be described, with reference to the drawings. In this embodiment, one exemplary case, in which a paper sheet handling machine comprising a paper sheet holding apparatus of the present invention is used as a banknote handling machine for handling banknotes, will be discussed. However, any other suitable paper sheets than the banknotes may be used as an object to be handled by the paper sheet holding apparatus and paper sheet handling machine of the present invention. It should be construed that this embodiment has no intent to limit the scope of the present invention, but is merely intended to describe and show one preferred example thereof.

First, referring to FIGS. 1 and 2, general construction of the banknote handling machine comprising a banknote holding apparatus of the present invention will be discussed.

Figure 1:
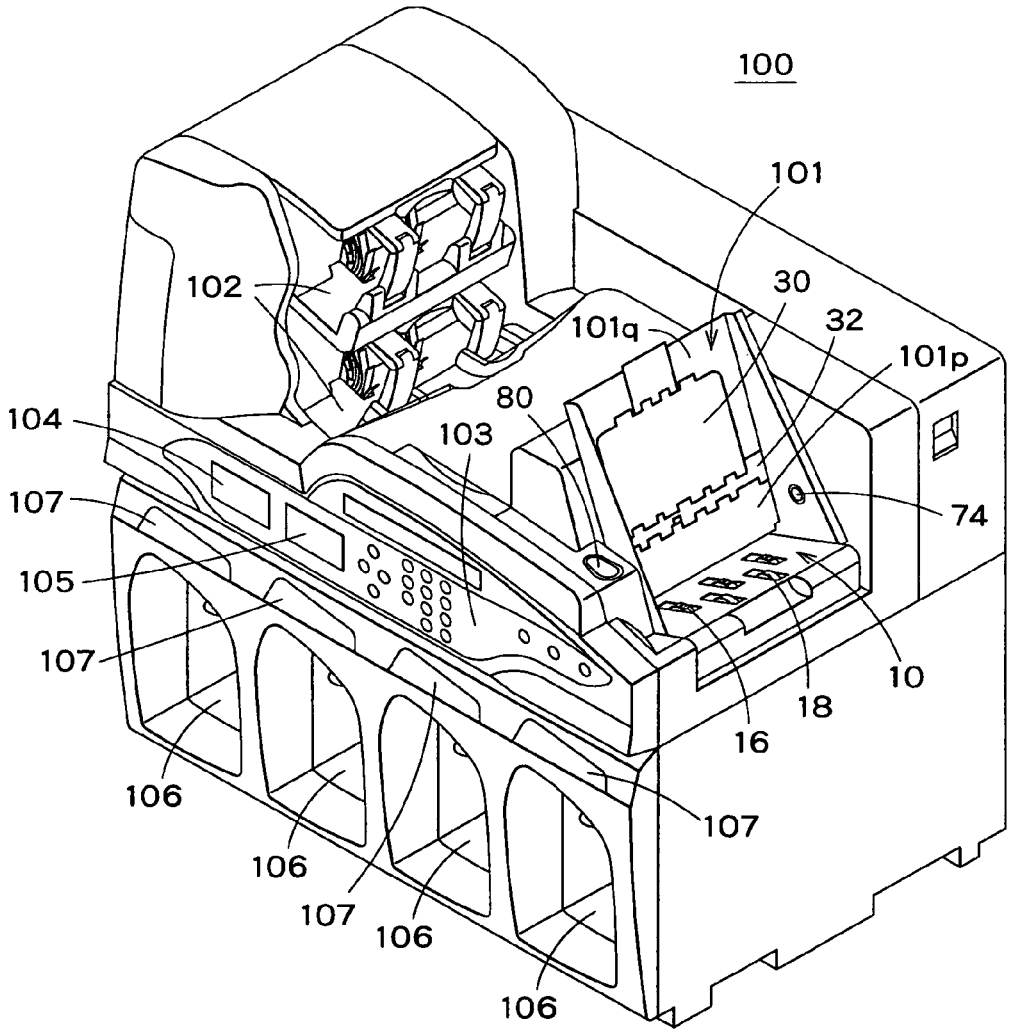
FIG. 1 is a perspective view showing an outline of a banknote handling machine comprising a banknote holding apparatus of the present invention.

FIG. 1 is a perspective view showing an outline of the banknote handling machine 100 related to one exemplary embodiment of the present invention. As shown in FIG. 1, the banknote handling machine 100 comprises a hopper 101, two reject units 102, an operation unit 103, a first general display unit 104, a second general display unit 105, four stacking units 106 and four individual display units 107.

The hopper 101 is configured such that a plurality of banknotes can be placed thereon, in a stacked condition, by the operator. The banknotes once stored in the hopper 101 will be fed to the interior of the banknote handling machine 100 by a banknote feeding mechanism 10 as will be described later. Specific construction of the hopper 101 will be discussed below in more detail. Each reject unit 102 can serve to discharge the banknote, when the banknote fed from the hopper 101 is a rejected banknote (e.g., a counterfeit banknote or the like). For instance, a lower one of the two reject units 102 may be used for discharging each counterfeit banknote or the like, while the upper reject unit 102 may be used for storing therein each banknote excluded from ones to be sorted although it has been recognized by a recognition unit 220 as will be described below.

The operation unit 103 includes input keys for inputting instructions of the operator therein. The first general display unit 104 and second general display unit 105 are respectively provided for displaying predetermined data (e.g., graphic data or the like). Each stacking unit 106 is configured to stack therein the banknotes fed from the hopper 101 due to the banknote feeding mechanism 10, for each attribute (e.g., denomination or the like) of the banknotes. Each individual display unit 107 is provided corresponding to each stacking unit 106, and is configured to display the number of banknotes stacked in the corresponding stacking unit 106. While the two reject units 102, four stacking units 106 and four individual display units 107 are respectively depicted in FIG. 1, each number of these components can be altered without any limitation.

Figure 2:
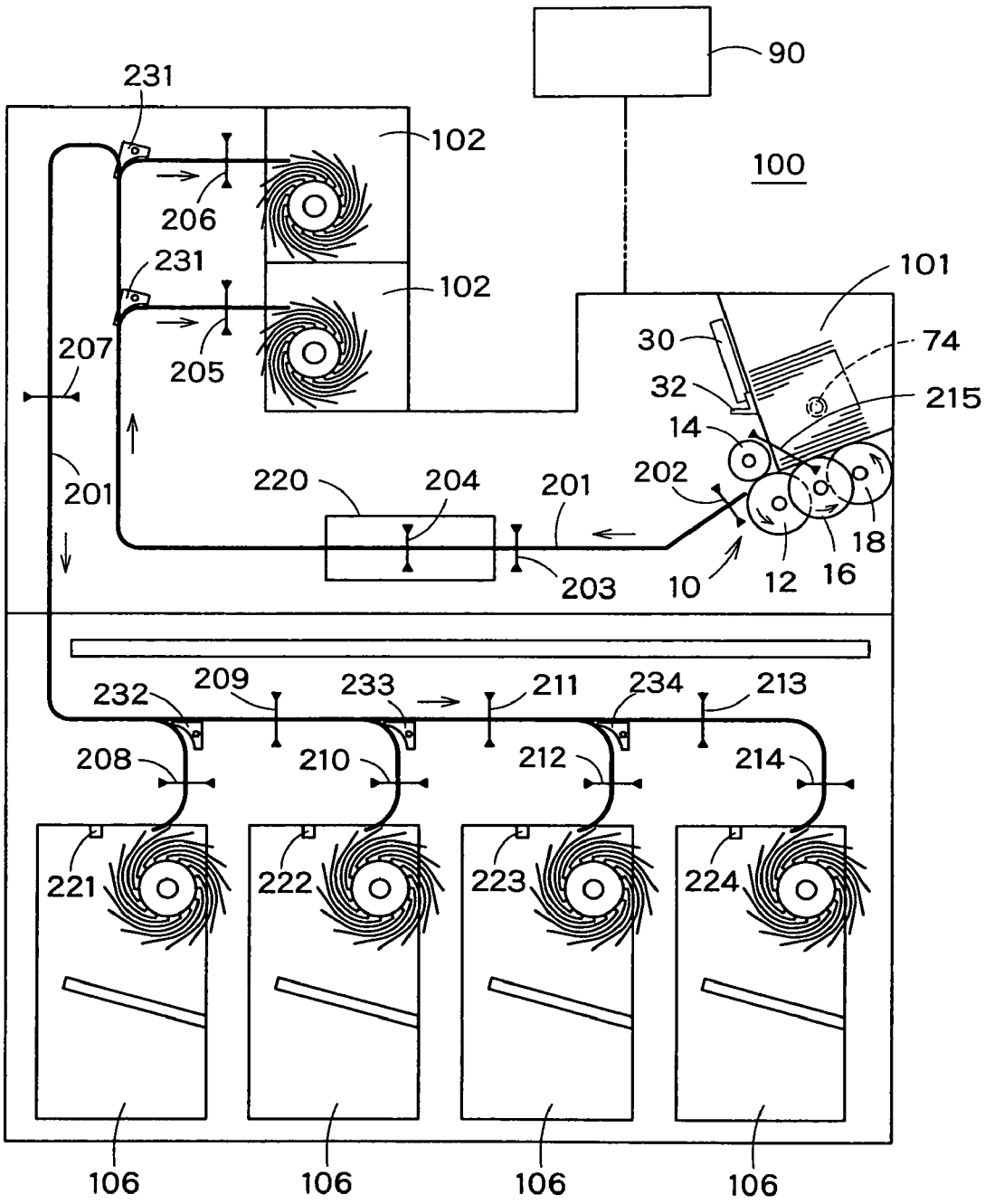
FIG. 2 is a schematic diagram showing general internal construction of the banknote handling machine shown in FIG. 1.

FIG. 2 is a schematic diagram showing general internal construction of the banknote handling machine 100 shown in FIG. 1, and is intended in particular to illustrate a transport system and a sensor system thereof.

As shown in FIG. 2, a transport path 201 configured for transporting each banknote to each stacking unit 106 from the hopper 101 is provided in the banknote handling machine 100. Usually, the transport path 201 is composed of several belt transport mechanisms combined with one another. Various sensors 202 to 214 are provided along the transport path 201. Among them, the sensor 202 provided, on the side of an outlet of the hopper 101, for detecting a banknote feed condition, and the sensor 203 provided on the side of an inlet of the recognition unit 220 as will be described later can serve to detect whether or not each banknote is securely taken in the transport path 201, respectively. The recognition unit 220 provided along the transport path 201 is composed of various detection units, and serves to detect new/old, fitness, authentication, denomination, orientation, face/back and the like of each banknote taken therein from the hopper 101. More specifically, a sensor 204 composed of, for example, a transparent sensor is provided along the transport path 201.

On the downstream side relative to the recognition unit 220 in the transport path 201, two diverters 231 are provided in series. Each diverter 231 is configured to feed each banknote that cannot be recognized in the recognition unit 220 or banknote that is excluded from ones to be sorted although it has been recognized by the recognition unit 220, to each corresponding reject unit 102. The sensors 205, 206 can serve to detect that each banknote is fed from each diverter 231 to each corresponding reject unit 102, respectively. Meanwhile, each banknote selected as one to be sorted is detected, about its transported condition, by the sensor 207, and then further transported through the transport path 201. On the downstream side relative to the diverters 231 in the transport path 201, three diverters 232 to 234 are further provided in series. Each diverter 232 to 234 can serve to feed each banknote, which has been fed from each upstream diverter 231, toward each corresponding one of the four stacking units 106, in accordance with, for example, the denomination or the like of the banknote. In this way, each banknote that has been recognized, about the denomination or the like thereof, by the recognition unit 220 is stored in a suitable one of the four stacking units 106. The sensors 208 to 214 can serve to detect whether or not the sorting operation for the banknotes from the transport path 201 to each stacking unit 106 is appropriately performed, respectively. Additionally, as shown in FIG. 2, a transparent sensor 215 is provided to the hopper 101. This transparent sensor 215 can serve to detect that the banknotes are stored in the hopper 101. Further, the storage condition of the banknotes in each stacking unit 106 is detected by each corresponding residue detection sensor 221 to 224.

Figure 5:
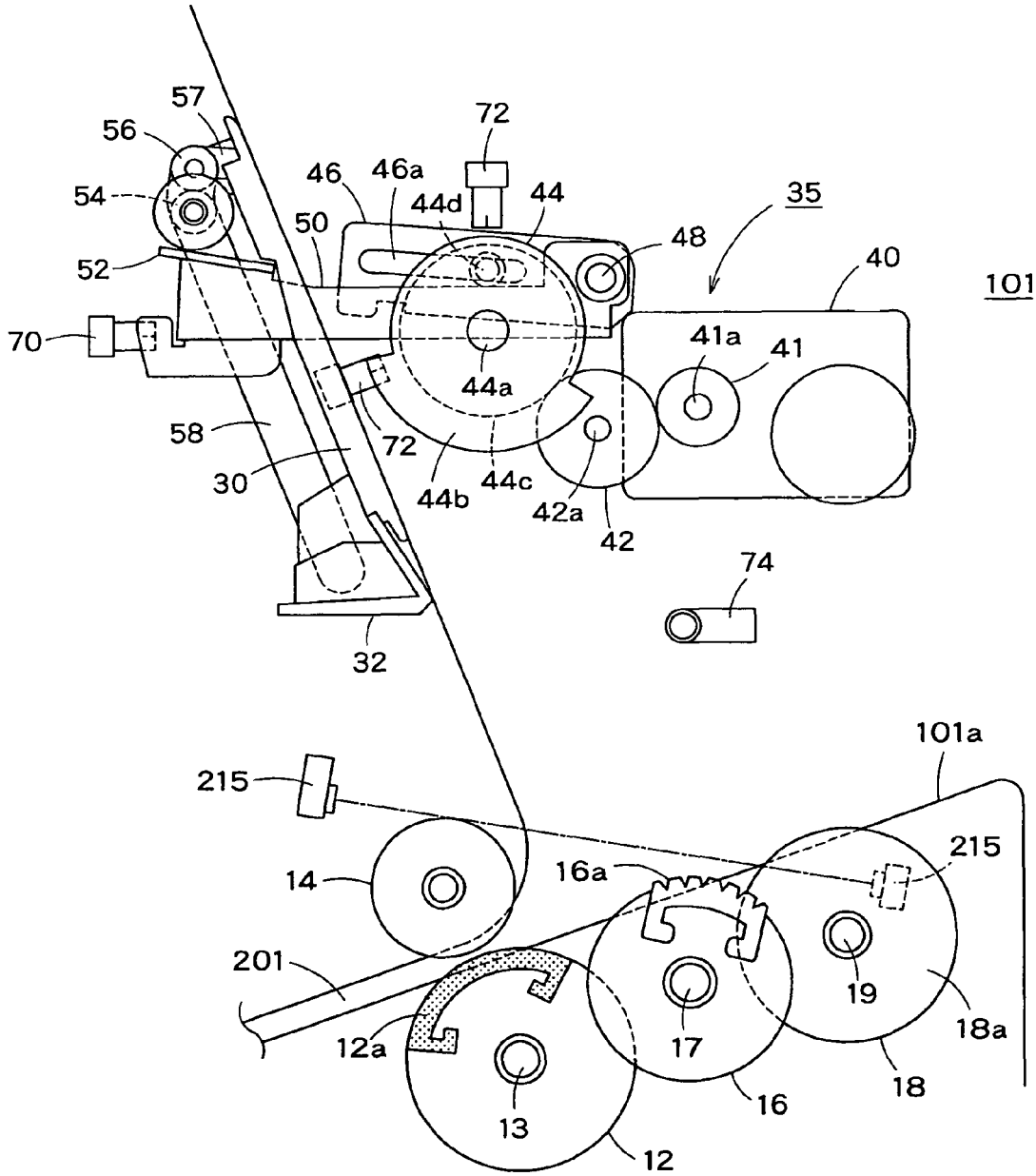
FIG. 5 is a side view showing the construction of the banknote holding apparatus of the present invention, illustrating the state in which each holding member of the banknote holding apparatus is in the waiting position.
Figure 6:
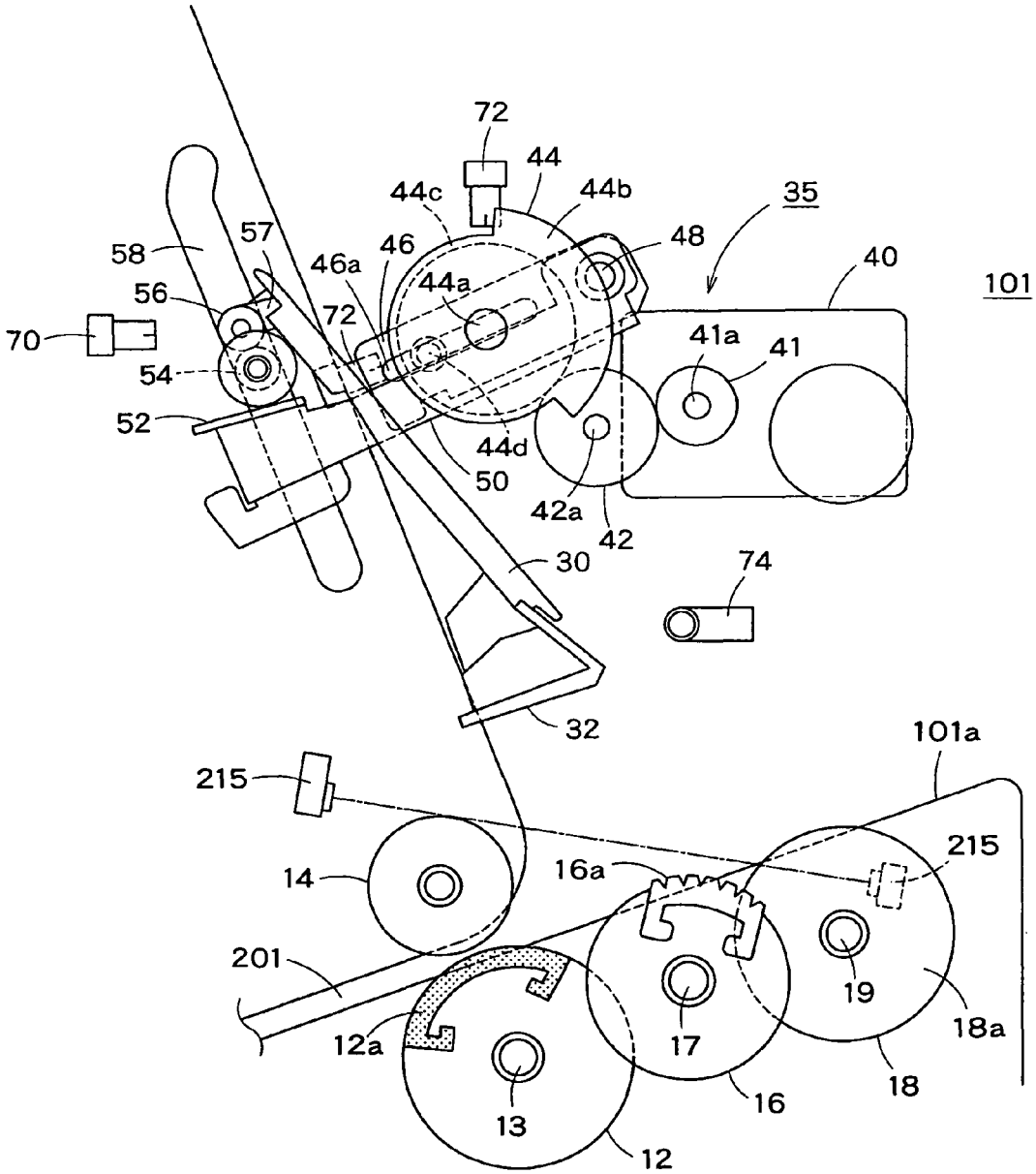
FIG. 6 is a side view showing the construction of the banknote holding apparatus of the present invention, illustrating a state in which each holding member of the banknote holding apparatus is being moved from the waiting position to the holding position, or vice versa.
Figure 7:
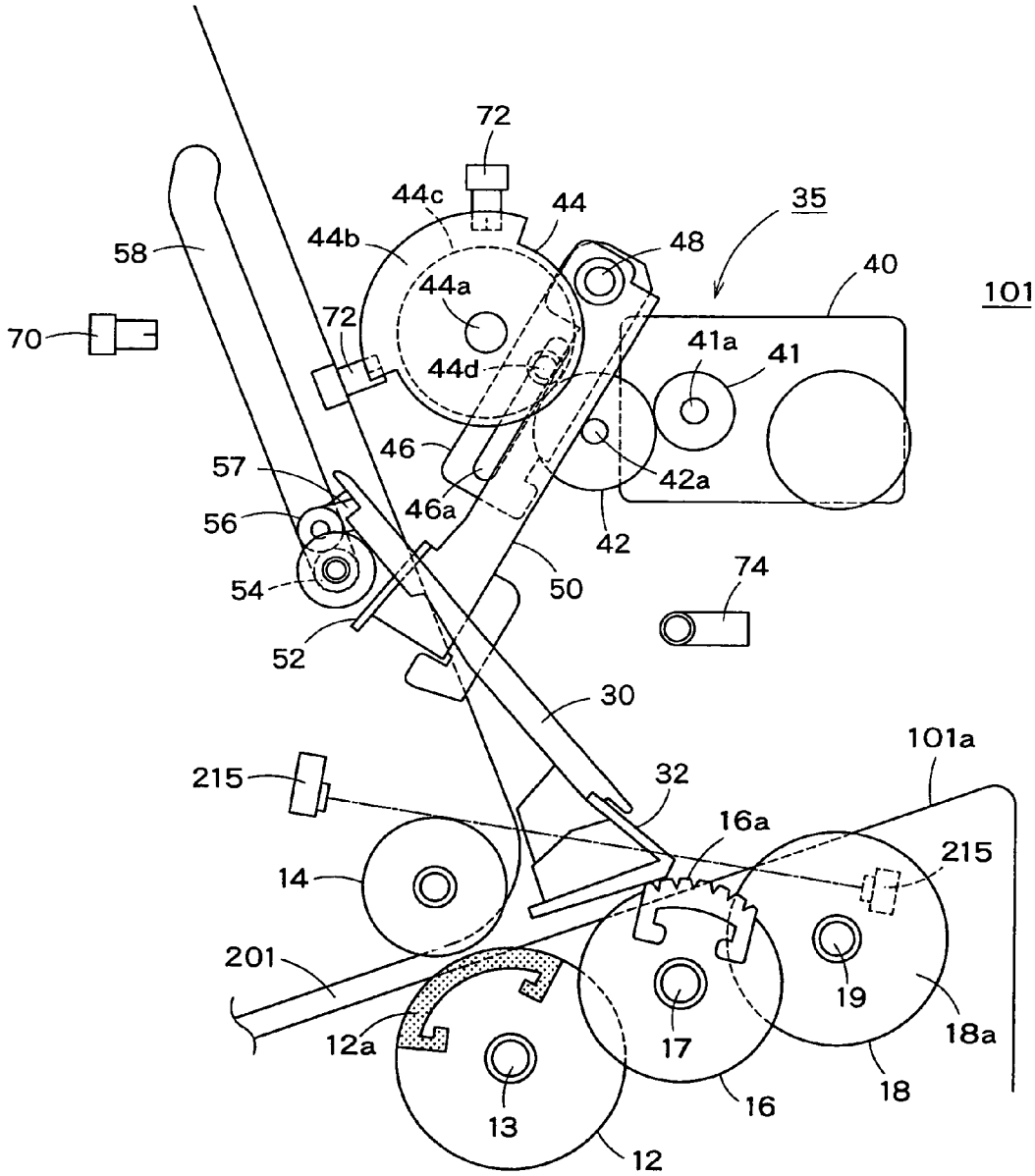
FIG. 7 is a side view showing the construction of the banknote holding apparatus of the present invention, illustrating the state in which each holding member of the banknote holding apparatus is in the holding position.

Now, referring to FIGS. 5 through 7, construction of the banknote feeding mechanism 10, provided in the banknote handling machine 100 shown in FIGS. 1 and 2, will be described in detail. The banknote feeding mechanism 10 is provided for feeding the banknotes stored in the hopper 101, one by one, to the transport path 201 in the banknote handling machine 100. FIGS. 5 through 7 are side views, each showing the construction of the banknote feeding mechanism 10.

First, referring to FIG. 5 and other related drawings, the hopper 101 adapted for storing therein the banknotes to be fed by the banknote feeding mechanism 10 will be described. This hopper 101 has a bottom face 101*a*, on which the banknotes can be stored in the stacked condition. As shown in FIGS. 1 and 5 and the other related drawings, the hopper 101 is opened upward and forward (or rightward in FIG. 5). As described above, the transparent sensor 215, adapted for detecting that at least one banknote is stored in the hopper 101, is provided to the hopper 101.

As shown in FIG. 5 and the other related drawings, the banknote feeding mechanism 10 comprises first kicker rollers 16, each provided to be in contact with a surface of one banknote present at the lowest layer of the plurality of banknotes stored in the stacked condition in the hopper 101, second kicker rollers 18, each located upstream relative to the first kicker rollers 16 in a feed direction of the banknotes, and feed rollers 12, each located downstream relative to the first kicker rollers 16 in the feed direction of the banknotes and adapted for feeding each banknote kicked out by the first kicker rollers 16. In addition, gate rollers (or reversal rollers) 14 are provided to be opposed to the corresponding feed rollers 12, thereby forming a gate part between each gate roller 14 and each feed roller 12. With such configuration, the banknotes kicked out by the first kicker rollers 16 can be fed to the transport path 201, one by one, through the gate parts.

The feed rollers 12 include a pair of left and right rollers (only one feed roller 12 is shown in FIG. 5 and the other related drawings), each having a rubber 12*a* partly provided to an outer circumference thereof. Namely, each banknote kicked out by the first kicker rollers 16 will be fed out by the rubbers 12*a* at the gate parts. One common shaft 13 is provided for the pair of left and right feed rollers 12. This shaft 13 is configured to be continuously rotated by a stepping motor (not shown).

The gate rollers 14 include a pair of left and right rollers (only one gate roller 14 is shown in FIG. 5 and the other related drawings), each provided to be opposed to each corresponding feed roller 12, as shown in FIG. 5 and the other related drawings. A rubber is provided to an outer circumference of each gate roller 14. As described above, the gate part is formed between each gate roller 14 and each corresponding feed roller 12. This gate part is formed into a gap corresponding to the thickness of one banknote. Thus, the banknotes kicked out by the first kicker rollers 16 can be fed through gate parts, while being restricted one by one. More specifically, each gate roller 14 is usually provided to be rotated, intermittently, in a direction reverse to the feed direction of the banknotes. With such intermittent reverse rotation of each gate roller 14, the whole outer-circumferential face of the gate roller 14 can be utilized, evenly, for forming the gate part. Therefore, uneven wear of each gate roller 14 can be successfully prevented. In this case, when only one banknote is fed to the gate part between each gate roller 14 and each corresponding feed roller 12, this banknote can be fed to the transport path 201 by the feed roller 12. However, when two or more banknotes are fed to the gate part while being overlapped one on another, gate rollers 14 can serve to prevent the second and later banknotes from being fed through the gate part together with the first banknote (in an overlapped condition).

Each first kicker roller 16 is provided to be in contact with the surface of one banknote present at the lowest layer of the plurality of banknotes stored in the stacked condition in the hopper 101, as shown in FIG. 5 and the other related drawings, and is configured to be continuously rotated. More specifically, a shaft 17 is commonly provided to the first kicker rollers 16, such that the shaft 17 of the first kicker rollers 16 is rotated together with the shaft 13 of the feed rollers 12, due to an interlock mechanism (not shown). Thus, when the shaft 13 of the feed rollers 12 is rotated by the stepping motor, the shaft 17 of the first kicker rollers 16 is continuously rotated together with the shaft 13. Additionally, as shown in FIG. 5 and the other related drawings, each first kicker roller 16 has a high friction unit 16*a* partly provided in an outer circumference thereof for kicking each banknote. Therefore, once each first kicker roller 16 is rotated and the high friction unit 16*a* thereof is in contact with the banknote of the lowest layer in the hopper 101, this banknote will be kicked out toward the feed rollers 12.

The second kicker rollers 18 are located upstream relative to the first kicker rollers 16 in the feed direction of the banknotes, respectively, as shown in FIG. 5 and the other related drawings. Each second kicker roller 18 is configured to be continuously rotated. More specifically, a single shaft 19 is provided commonly to the second kicker rollers 18, such that the shaft 19 of the second kicker rollers 18 is rotated together with the shaft 13 of the feed rollers 12, due to an interlock mechanism (not shown). Thus, when the shaft 13 of the feed rollers 12 is rotated by the stepping motor, the shaft 19 of the second kicker rollers 18 is continuously rotated together with the shaft 13. Additionally, as shown in FIG. 5 and the other related drawings, each second kicker roller 18 has a low friction unit 18*a* provided over the whole outer circumference thereof. The coefficient of friction of the low friction unit 18*a* is lower than the coefficient of friction of the high friction unit 16*a* of each first kicker roller 16. Therefore, when the banknote is in contact with each second kicker roller 18, such a banknote can be always kicked toward the feed rollers 12 due to the low friction unit 18*a*. It is noted that the diameter of each second kicker roller 18 is approximately the same as that of each first kicker roller 16, and is, for example, about 40 mm.

The banknote feed detection sensor 202 provided in an outlet portion of the banknote feeding mechanism 10, as shown in FIG. 1, can serve to detect occurrence of inconvenience, such as a jam or the like trouble, in the feeding operation for the banknotes performed by the banknote feeding mechanism 10. For instance, in the case in which one banknote is first fed and then a second banknote is fed by the banknote feeding mechanism 10, and if the banknote feed detection sensor 202 does not detect the second banknote after a predetermined period of time later than the detection of the first banknote, the banknote feed detection sensor 202 will detect the occurrence of inconvenience, such as the jam or the like trouble, in the feeding operation for the banknotes performed by the banknote feeding mechanism 10.

Next, specific construction of the banknote holding apparatus, which comprises holding members 30, 32, each adapted for holding, from above, the plurality of banknotes stored in the stacked condition in the hopper 101, will be discussed, with reference to FIGS. 3 through 7.

Figure 3:
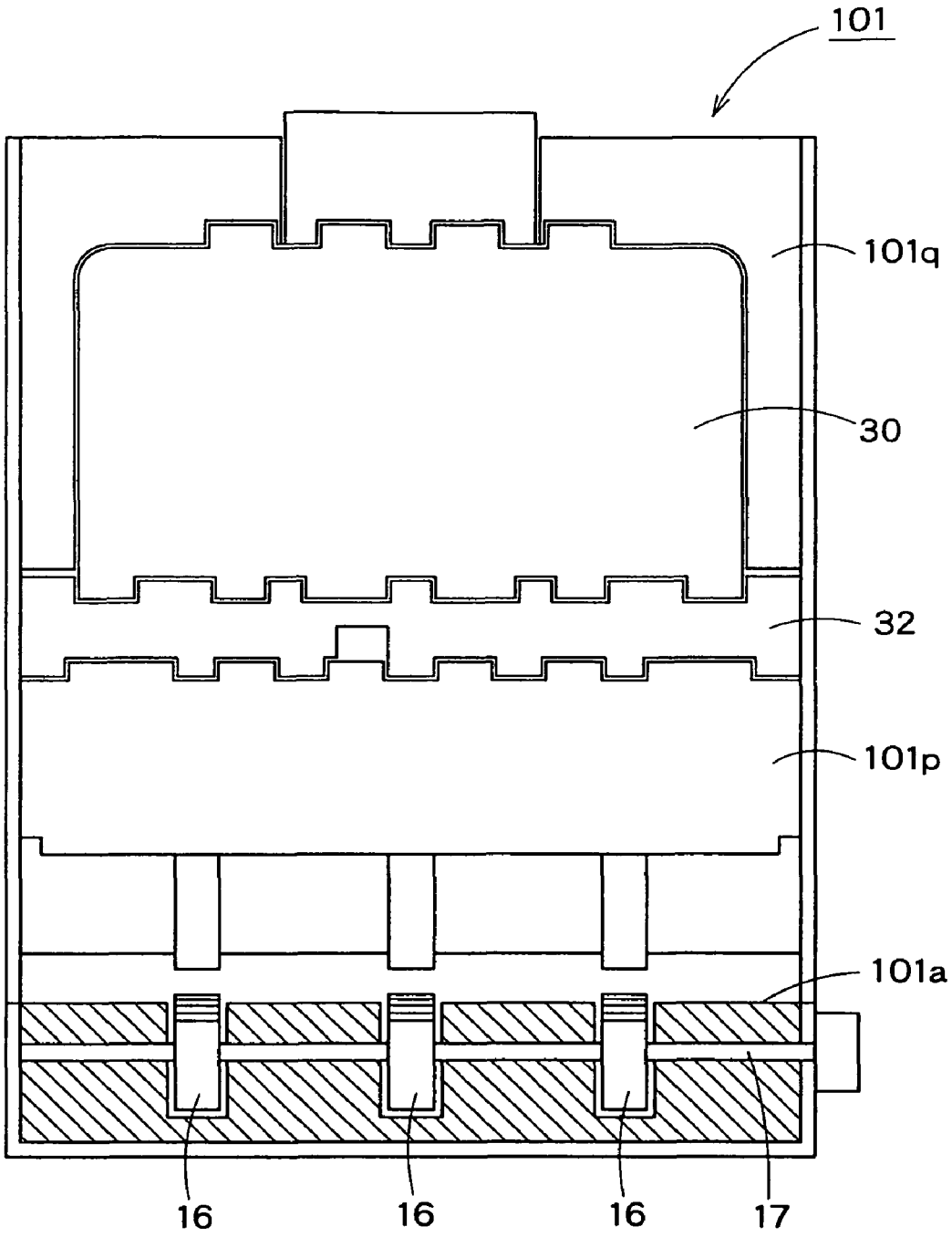
FIG. 3 is a front view of a hopper of the banknote handling machine shown in FIG. 1, illustrating a state in which each holding member of the banknote holding apparatus is in a waiting position.
Figure 4:
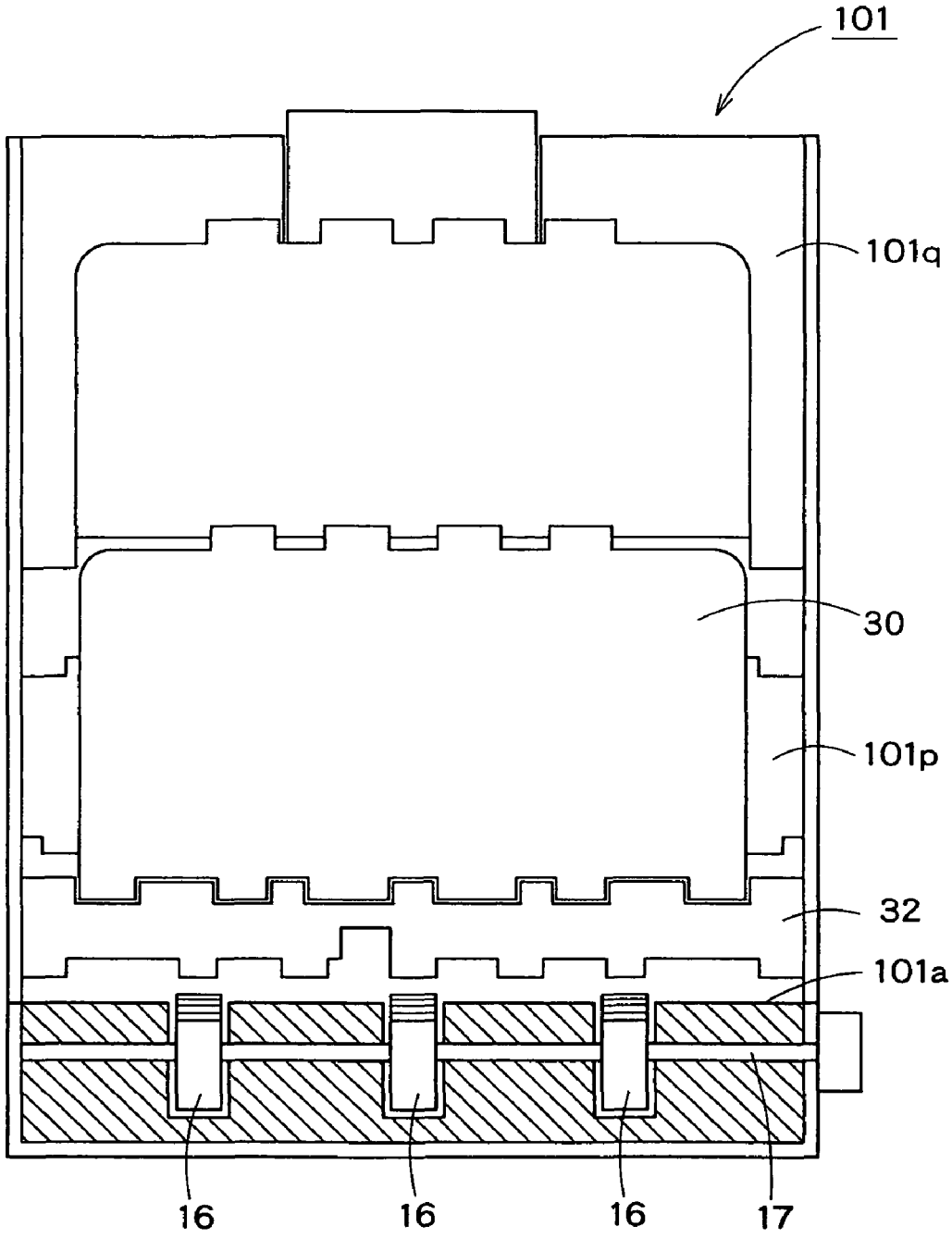
FIG. 4 is a front view of the hopper of the banknote handling machine shown in FIG. 1, illustrating a state in which each holding member of the banknote holding apparatus is in a holding position.

First, general construction of the banknote holding apparatus will be described in brief. The banknote holding apparatus comprises the upper holding member 30 and lower holding member 32, which are connected, integrally and vertically, with each other. The lower holding member 32 is configured to directly hold a batch of the banknotes stored in the hopper, from above. Both of the upper holding member 30 and lower holding member 32 can be reciprocated integrally between a waiting position as shown in FIGS. 1, 3 and 5 and a holding position as shown in FIGS. 4 and 7. When the respective holding members 30, 32 are in the waiting position, as shown in FIG. 5, such holding members 30, 32 can serve as a guide surface for guiding the batch of the stored banknotes, while being positioned on a back side (or left side in FIG. 5) of the hopper 101. Meanwhile, when the respective holding members 30, 32 are in the holding position, as shown in FIG. 7, the lower holding member 32 is in contact with a top face of the banknote present at the highest layer of the stored banknotes and presses the banknote downward. Such holding members 30, 32 are respectively configured to be optionally reciprocated between the waiting position and the holding position by a lifting and lowering mechanism 35 as will be described later. The lifting and lowering mechanism 35 is controlled by a controller 90. In addition, a banknote storage amount detection sensor 74 is provided for detecting that an amount of the banknotes stored in the hopper 101 exceeds a preset amount.

Now, each component of the above banknote holding apparatus will be described in more detail, with reference to FIGS. 3 through 7.

As shown in FIGS. 1, 3 and 5, the upper holding member 30 and lower holding member 32 are respectively composed of substantially rectangular plate members, which are connected, integrally and vertically, with each other. As described above, when the respective holding members 30, 32 are in the waiting position, as shown in FIGS. 3 and 5, the upper holding member 30 serves, mainly, as the guide surface (or guide plate) for guiding the batch of the stored banknotes, while being positioned on the back side (or left side in FIG. 5) of the hopper 101. Meanwhile, when the respective holding members 30, 32 are in the holding position, as shown in FIGS. 4 and 6, the lower holding member 32 is in contact with the top face of the banknote present at the highest layer of the stored banknotes, and serves, mainly, to press the banknote downward.

As shown in FIGS. 5 through 7, the position of the upper holding member 30 when the respective holding members 30, 32 are in the waiting position is on the back side (or left side in FIG. 5) of the hopper 101 with respect to and higher than the position of the upper holding member 30 when the respective holding members 30, 32 are in the holding position. Namely, as the respective holding members 30, 32 are moved from the holding position as shown in FIG. 7 to the waiting position as shown in FIG. 5, via a state as depicted in FIG. 6, by the lifting and lowering mechanism 35 as will be described later, each holding member 30, 32 will be moved backward and upward, so as to increase an angle of the upper holding member 30 relative to the bottom plate 101*a* of the hopper 101. In this manner, as the upper holding member 30 is moved from the holding position to the waiting position, this member 30 will be retracted and eventually stored in a side plate on the back side 20. (or left side in FIG. 7) of the hopper 101, as shown in FIG. 5, from a state in which a lower portion of the upper holding member 30 is advanced forward (or rightward in FIG. 7) from the side plate on the back side of the hopper 101, as shown in FIG. 7. With such movement of the respective holding members 30, 32 as described above due to the lifting and lowering mechanism 35, the assembly of the respective holding members 30, 32 can serve as a holding mechanism for holding the batch of the banknotes stored in the hopper 101 as well as can serve as a guide mechanism for guiding the batch of the banknote stored in the hopper 101, while being positioned on the back side of the hopper 101.

As shown in FIG. 3 and other related drawings, an upper edge and a lower edge of the upper holding member 30 as well as an upper edge and a lower edge of the lower holding member 32 are comb-shaped, respectively. The comb-shape of the lower edge of the upper holding member 30 and the comb-shape of the upper edge of the lower holding member 32 can be fitted relative to each other. Further, when the respective holding members 30, 32 are in the waiting position, as shown in FIGS. 1 and 3, an upper edge of a lower side plate 101*p* on the back side of the hopper 101 located below the lower holding member 32 as well as a lower edge of an upper side plate 101*q* on the back side of the hopper 101 located above the upper holding member 30 are also comb-shaped, respectively. When the respective holding members 30, 32 are in the waiting position, the comb-shape of the lower edge of the lower holding member 32 and the comb-shape of the upper edge of the lower side plate 101*p* on the back side of the hopper 101 can be fitted relative to each other, while the comb-shape of the upper edge of the upper holding member 30 and the comb-shape of the lower edge of the upper side plate 101*q* on the back side of the hopper 101 can be fitted relative to each other. With such configuration, when the respective holding members 30, 32 are in the waiting position, unexpected trouble such that some banknotes stored in the hopper 101 would accidentally get in a gap between the upper edge of the lower side plate 101*p* on the back side of the hopper 101 and the lower edge of the lower holding member 32, can be prevented. Similarly, when the respective holding members 30, 32 are in the waiting position, another trouble such that some banknotes stored in the hopper 101 would accidentally get in a gap between the lower edge of the upper side plate 101*q* on the back side of the hopper 101 and the upper edge of the upper holding member 30, can also be prevented.

Meanwhile, when the respective holding members 30, 32 are in the holding position, as shown in FIG. 4, each projection of the comb-shape of the lower edge of the lower holding member 32 is located above each kicker roller 16 of the banknote feeding mechanism 10. Namely, when the respective holding members 30, 32 are in the holding position, the batch of the banknotes stored in the hopper 101 will be pressed between each projection of the comb-shape of the lower edge of the lower holding member 32 and the kicker rollers 16. In this way, when the banknotes stored in the hopper 101 are fed out by the respective kicker rollers 16 of the banknote feeding mechanism 10, each portion of the banknote present at the lowest layer that will be in contact with each kicker roller 16 can be directly pressed downward by the lower holding member 32. Thus, the feeding operation for the banknotes due to the kicker rollers 16 can be performed, more securely, by this configuration.

As shown in FIG. 1 and other drawings, the banknote storage amount detection sensor 74 composed of, for example, an optical sensor, is provided to one side plate of the hopper 101. The banknote storage amount detection sensor 74 can serve to detect that the amount of the banknotes stored in the hopper 101 exceeds the preset amount. Specifically, the optical sensor of the banknote storage amount detection sensor 74 is preferably located at a height within a range of 50 to 70 mm, more preferably 60 to 70 mm, from the bottom face 101*a* of the hopper 101. Therefore, the optical sensor can detect that the banknotes are stored in the hopper 101 in a greater amount than the preset amount thereof, based on block of light emitted from the optical sensor due to the stored banknotes. It is noted that, as shown in FIGS. 5 through 7, the banknote storage amount detection sensor 74 is located, in a position such that the light emitted in the horizontal direction from the optical sensor thereof can travel outside a region in which the respective holding members 30, 32 can be moved between the waiting position as shown in FIG. 5 and the holding position as shown in FIG. 7. It is also contemplated herein that the entire body of the banknote holding apparatus can be made significantly compact because the optical sensor of the banknote storage amount detection sensor 74 is located at the height of 70 mm or less from the bottom face 101*a* of the hopper 101.

Next, further referring to FIGS. 5 through 7, specific construction of the lifting and lowering mechanism 35 for lifting and lowering the respective holding members 30, 32 will be described. The lifting and lowering mechanism 35 is composed mainly of a driving motor 40, a first cam 44, a second cam 46, and a third cam 50. The driving motor 40 serves to rotate a gear 41 about a shaft 41*a*. When the gear 41 is rotated by the driving motor 40, a gear 42 provided to be meshed with the gear 41 will be rotated about a shaft 42*a* together with the gear 41. The first cam 44 has a shaft 44*a*, a rotation detector 44*b* configured to have an outer circumference partly projected outward, a gear 44*c* provided to be meshed with the gear 42, and a guide pin 44*d* provided to a side face of the first cam 44. When the gear 42 is rotated, the gear 44*c* is also rotated about the shaft 44*a*, and thus the first cam 44 will be rotated. Further, when the first cam 44 is rotated, the guide pin 44*d* is also rotated about the shaft 44*a*.

The second cam 46 is configured to be optionally swung about a shaft 48 and has an elongated guide groove 46*a* formed in a side face thereof. In the guide groove 46*a*, the guide pin 44*d* of the first cam 44 can be inserted. Namely, as the guide pin 44*d* is guided in and along such an elongated guide groove 46*a*, the second cam 46 will be swung about the shaft 48, together with the rotational movement of the first cam 44, as shown in FIGS. 5 through 7. The third cam 50 is connected with the second cam 46 via a coil spring (not shown) provided to the shaft 48. In this case, the third cam 50 is configured to be swung about the shaft 48 together with the second cam 46. The coil spring provided between the second cam 46 and the third cam 50 can allow the rotation of the second cam 50 in an anticlockwise direction about the shaft 48 relative to the second cam 46. For instance, in a state as shown in FIG. 5, the third cam 50 can be rotated, such as by a manual operation, in the anticlockwise direction about the shaft 48, while the second cam 46 is in a stationary state. However, when the third cam 50 is released from a hand, it will be returned to the state as shown in FIG. 5 by the force of the coil spring.

A receiving plate 52 is provided to a top face of a distal portion of the third cam 50. Meanwhile, a lower guide roller 54 and an upper guide roller 56 are integrally provided to the upper holding member 30, respectively, via a support member 57. As shown in FIGS. 5 and 6, the receiving plate 52 provided to the distal portion of the third cam 50 is configured to receive thereon the lower guide roller 54 of the upper holding member 30. Both of the lower guide roller 54 and upper guide roller 56 are arranged to be guided by an elongated guide groove 58 provided on the back side (or left side in FIG. 5 and the other drawings) of the hopper 101. Namely, when the third cam 50 is swung about the shaft 48, the lower guide roller 54 received on the receiving plate 52 located at the distal portion of the third cam 50 as well as the upper guide roller 56 integrally arranged with the lower guide roller 54 will be vertically moved along the guide groove 58. As such, the upper holding member 30 supporting the respective guide rollers 54, 56 via the support member 57 can also be vertically moved. It is noted that a transfer path for the respective holding members 30, 32, between the waiting position and the holding position thereof, can be determined, based on the shape of the guide groove 58.

Additionally, a sensor 70, for detecting the position of the third cam 50, is provided to the lifting and lowering mechanism 35. This sensor 70 can serve to detect the position of the third cam 50, when the respective holding members 30, 32 are in the waiting position, and hence the cam 50 is located as shown in FIG. 5. Furthermore, two sensors 72 are provided for respectively detecting the rotational position of the first cam 44. These sensors 72 can serve to detect, respectively, the rotation detector 44*b* provided to the first cam 44 and configured to have an outer circumference partly projected outward. With the provision of such sensors 70, 72, when the respective holding members 30, 32 are in the waiting position as shown in FIG. 5, the sensor 70 can detect the third cam 50, while one of the two sensors 72 can detect the rotation detector 44*b*. Then, based on the detection results of these sensors 70, 72, the controller 90, as will be described later, can recognize that the respective holding members 30, 32 are currently in the waiting position thereof. Meanwhile, when the respective holding members 30, 32 are in the holding position as shown in FIG. 7, the two sensors 72 can respectively detect the rotation detector 44*b*. Thus, the controller 90 can determine that the respective holding members 30, 32 are in the holding position thereof, at that time.

In addition, in the case in which a finger or the like of the user is lodged between the upper holding member 30 and the upper side plate 101*q* on the back side of the hopper 101, while the respective holding members 30, 32 are in the vicinity of the waiting position, the sensor 70 cannot detect the third cam 50, while one of the two sensors 72 can detect the rotation detector 44*b*. In this case, the controller 90 determines that something is lodged between the upper holding member 30 and the upper side plate 101*q* on the back side of the hopper 101, while the respective holding members 30, 32 are located in the vicinity of the waiting position thereof.

Further, as shown in FIG. 1, a holding member lift-up button 80 is provided to a top face of the banknote handling machine 100. When a user of this banknote handling machine 100 pushes the holding member lift-up button 80, the controller 90, as will be described later, will control the lifting and lowering mechanism 35 to move the respective holding members 30, 32 toward the waiting position thereof.

Next, the operation of the banknote handling machine 100, especially the control for the lifting and lowering mechanism 35 due to the controller 90 in the banknote holding apparatus, will be described, with reference to FIGS. 3 through 7.

In an initial state of the banknote handling machine 100, the respective holding members 30, 32 are in the waiting position as shown in FIGS. 1, 3, 5. In this case, both of the upper holding member 30 and lower holding member 32 can serve as the guide surface for guiding the batch of the banknotes stored in the hopper 101, while being positioned on the back side of the hopper 101. Since the hopper 101 is opened both upward and forward, the user can store the batch of the banknotes in the hopper 101, more easily, as compared with the hopper opened only in either one of the upward or forward direction. Thereafter, when the user pushes a start button (not shown), the operation of the banknote handling machine 100 will be started. In this case, the transparent sensor 215 can detect that the banknotes are stored in the hopper 101.

When the banknotes are stored, in a relatively large amount, in the hopper 101, and when the banknote storage amount detection sensor 74 provided to the side plate of the hopper 101 detects that the amount of the banknotes stored in the hopper 101 is greater than the preset amount, more specifically when the sensor 74 detects that the height of the batch of the banknotes stored in the hopper 101 exceeds, for example, 50 mm (about 500 sheets), and especially when the sensor 74 detects that the height of the batch of the banknotes stored in the hopper 101 exceeds, for example, 60 mm (about 600 sheets), the banknotes can be considered to be stored, in a sufficient amount, in the hopper 101. Therefore, the banknote present at the lowest layer in such a case will not have any crease, due to the weight of the batch of the banknotes loaded thereon. As such, the feeding operation can be smoothly performed, without holding the batch of the banknotes stored in the hopper 101 due to the banknote holding apparatus. Thus, in the case in which the banknote storage amount detection sensor 74 detects that the number of the banknotes stored in the hopper 101 is greater than the preset amount, the respective holding members 30, 32 will be kept in the waiting position.

Meanwhile, when the banknotes are stored, in a relatively small amount, in the hopper 101, and when the banknote storage amount detection sensor 74 provided to the side plate of the hopper 101 detects that the amount of the banknotes stored in the hopper 101 is smaller than the preset amount, the controller 90 controls the lifting and lowering mechanism 35 to move the respective holding members 30, 32 to the holding position thereof. More specifically, in such a state as shown in FIG. 5, the driving motor 40 will first rotate the gear 41, and thus the gear 42 will be rotated together with the gear 41, resulting in the anticlockwise rotation of the first cam 44 about the shaft 44*a*. In this case, since the guide pin 44*d* of the first cam 44 is also rotated in the anticlockwise direction about the shaft 44*a*, this guide pin 44*d* will be guided along the guide groove 46*a* of the second cam 46, resulting in the anticlockwise rotation of the second cam 46 about the shaft 48. Consequently, the third cam 50 will also be rotated in the anticlockwise direction about the shaft 48 together with the second cam 46, thus the receiving plate 52 will be moved downward, while receiving the lower guide roller 54 thereon. When the receiving plate 52 is moved downward, the lower guide roller 54 will also be moved downward, together with the upper guide roller 56, while being guided along the guide groove 58, due to the weight of the upper holding member 30 and lower holding member 32. In this case, the guide groove 58 has a portion extending in the vicinity of a top end thereof while bending toward the front (or rightward in FIG. 5) of the hopper 101, such that the upper guide roller 56 is stored in such a bending portion, when the respective holding members 30, 32 are in the waiting position. Therefore, as the assembly of the guide rollers 54, 56 is moved downward, the upper holding member 30 will take such an attitude that a lower portion thereof is advanced toward the front of the hopper 101. Thereafter, when the third cam 50 is further rotated in the anticlockwise direction about the shaft 48, as shown in FIG. 7, the assembly of the respective guide rollers 54, 56 is moved up to a bottom end of the guide groove 58, while the lower guide roller 54 is separated from the receiving plate 52. As a result, when both of the two sensors 72 detect the rotation detector 44*b* of the first cam 44, the respective holding members 30, 32 will be judged to have reached the holding position thereof. Then, the driving motor 40 is stopped by the controller 90. It is noted that FIG. 7 illustrates, for convenience, one exemplary case in which the banknotes are not placed on the bottom face 101*a* of the hopper 101. Actually, however, the batch of the banknotes are placed on the bottom face 101*a*, and the respective holding members 30, 32 are used for holding the batch of the banknotes present on the bottom face 101*a*, from above, by the weight thereof.

As described above, if the batch of the banknotes has been initially stored in the hopper 101, with the height of the batch of the banknotes exceeding the preset height determined by the banknote storage amount detection sensor 74, the banknote storage amount detection sensor 74 should detect, at that time, such a sufficient amount of the banknotes, and thus the respective holding members 30, 32 should be kept in the waiting position thereof. However, if the amount of the banknotes stored in the hopper 101 is then reduced to be less than the preset amount, as the banknotes in the hopper are fed into the banknote handling machine 100 by the banknote feeding mechanism 10, the banknote storage amount detection sensor 74 will no longer detect the sufficient amount of banknotes in the hopper 101. Also in such a case, the controller 90 automatically controls the lifting and lowering mechanism 35 to move the respective holding members 30, 32 to the holding position thereof.

Meanwhile, when the user wants to replenish the banknotes, anew, by hand, into the hopper 101, after a part or all of the banknotes already stored in the hopper 101 were fed into the banknote handling machine 100 by the banknote feeding mechanism 10, the user will push the holding member lift-up button 80. In such a case, the controller 90 automatically controls the lifting and lowering mechanism 35 to move the respective holding members 30, 32 from the holding position to the waiting position. With such control of the lifting and lowering mechanism 35 due to the controller 90, the respective holding members 30, 32 will return to the waiting position as shown in FIGS. 3, 5, thus the hopper 101 will be opened forward and upward. Therefore, the user can replenish the banknotes, from above or from the front, into the hopper 101. As described above, in the lifting and lowering mechanism 35, the second cam 46 and third cam 50 are connected via the shaft 48 by using the coil spring. Therefore, even when the finger of the user is lodged between the upper holding member 30 and the upper side plate 101*q* on the back side of the hopper 101, the third cam 50 can be rotated in the anticlockwise direction, relative to the second cam 46, about the shaft 48, against the force of the coil spring, thus preventing such a lodged finger from being seriously damaged.

Further, when the user pushes the holding member lift-up button 80, the controller 90 stops the rotation of the feed rollers 12, kicker rollers 16, 18 and the like of the banknote feeding mechanism 10. Then, once the user replenished the banknotes into the hopper 101, and when the banknote storage amount detection sensor 74 detects that the amount of the banknotes stored in the hopper 101 exceeds the preset amount, the controller 90 restarts the operation of the banknote feeding mechanism 10. It is noted that the controller 90 restarts the operation of the banknote feeding mechanism 10, not only when the banknote storage amount detection sensor 74 detects that the amount of the banknotes stored in the hopper 101 exceeds the preset amount, but also when the transparent sensor 215 detects that the banknotes are stored in the hopper 101 while the sensors 72 detect that the respective holding members 30, 32 are in the holding position. With such control performed by the controller 90, the operation of the banknote feeding mechanism 10 can be optionally stopped, when there is a possibility that the banknote present at the lowest layer of the banknotes stored in the hopper 101 may be creased. Then, the banknote feeding mechanism 10 will be restarted, once such a state that the banknote present at the lowest layer will be no longer folded, due to sufficient weight or pressing force loaded or applied thereon from above, can be obtained. Therefore, occurrence of some failure upon the feeding operation performed by the banknote feeding mechanism 10 can be prevented.

When the holding member lift-up button 80 is pushed by the user, the controller 90 will change a period of time required for the detection of the failure in the feeding operation, due to the banknote feed detection sensor 202, into a longer one than the period of time employed upon a normal operation. Namely, when a part or all of the banknotes stored in the hopper 101 are fed into the banknote handling machine 100 by the banknote feeding mechanism 10 and thus the amount of the banknotes stored in the hopper 101 is reduced so much, the pressing force applied to the banknote present at the lowest layer should also be reduced. This will make it rather difficult to continue a smooth feeding operation for the banknote present at the lowest layer by using the banknote feeding mechanism 10. In such a case, if the period of time for the detection of the failure upon the feeding operation is kept unchanged relative to the normal operation, there is a possibility that some failure may be detected mistakenly, even when no failure occurs, in fact, in the feeding operation performed by the banknote feeding mechanism 10, because of such a banknote present at the lowest layer that cannot be smoothly fed out by the banknote feeding mechanism 10. However, with the change of the period of time for the detection of the failure upon the feeding operation into an appropriately longer one, such a mistaken detection regarding failure upon the feeding operation performed by the banknote feeding mechanism 10 can be positively prevented.

In addition, when the user wants to replenish the banknotes, by hand, into the hopper 101, after a part or all of the banknotes stored in the hopper 101 were fed into the banknote handling machine 100 by the banknote feeding mechanism 10, the user can move the respective holding members 30, 32 from the holding position to the waiting position, by blocking the light emitted from the optical sensor of the banknote storage amount detection sensor 74, by using the batch of the banknotes that the user holds or by using the user's hand itself, without pushing the holding member lift-up button 80. In this case, the user can move the respective holding members 30, 32, without pushing the holding member lift-up button 80, thus significantly facilitating the operation of the banknote holding apparatus.

As discussed above, according to the banknote holding apparatus of this embodiment, the hopper 101 is opened upward and forward, and the respective holding members 30, 32 can be optionally moved between the waiting position and the holding position by the lifting and lowering mechanism 35. In this case, when the respective holding members 30, 32 are in the waiting position, such respective holding members 30, 32 can constitute together the guide surface, on the back side of the hopper 101, for guiding the batch of the banknotes stored in the hopper 101. Meanwhile, when the respective holding members 30, 32 are in the holding position, the lower holding member 32 can be contacted with the top face of the banknote present at the highest layer of the batch of the banknotes stored in the hopper 101 and serve to press the banknote downward. Furthermore, with the control of the lifting and lowering mechanism 35 due to the controller 90, the respective holding members 30, 32 will be moved to the waiting position, when the amount of the banknotes stored in the hopper 101 is detected to be greater than the preset amount by the banknote storage amount detection sensor 74. Meanwhile, when the amount of the banknotes stored in the hopper 101 is detected to be less than the preset amount by the banknote storage amount detection sensor 74, the respective holding members 30, 32 will be moved to the holding position. In this manner, the hopper 101 is opened upward and forward, while the respective holding members 30, 32 can serve as the guide surface, on the back side of the hopper 101, for guiding the batch of the banknotes stored in the hopper 101, when the respective holding members 30, 32 are in the waiting position. Therefore, upon the replenishment of the banknotes into the hopper 101, the user can replenish the batch of the banknotes into hopper 101 from above as well as from the front. This can significantly facilitate the replenishment work of the banknotes. Furthermore, with the provision of the banknote storage amount detection sensor 74, the respective holding members 30, 32 can be automatically moved to the waiting position, when the amount of the banknotes stored in the hopper 101 is greater than the preset amount. In this case, the weight of the batch of the banknotes stored in the hopper 101 can serve to prevent the banknote present at the lowest layer from being folded and creased, thus allowing additional replenishment of the banknotes to be performed freely.

Furthermore, when the respective holding members 30, 32 are in the waiting position, the upper holding member 30 can serve as the aforementioned guide surface, and the position of the upper holding member 30 when the respective holding members 30, 32 are in the waiting position is on the back side of the hopper 101 with respect to and higher than the position of the upper holding member 30 when the respective holding members 30, 32 are in the holding position. In addition, the upper end portion of the elongated guide groove 58 is bent toward the front (or rightward in FIG. 5) of the hopper 101. Therefore, the respective holding members 30, 32 can be moved to increase the angle of the upper holding member 30 relative to the bottom face 101*a* of the hopper 101, as the respective holding members 30, 32 are moved to the waiting position from the holding position by the lifting and lowering mechanism 35. Therefore, when the respective holding members 30, 32 are in the waiting position, the lower portion of the upper holding member 30 is retracted toward the back of the hopper 101. Thus, such a retracted upper holding member 30 can be used as a proper guide surface. Meanwhile, when the respective holding members 30, 32 are in the holding position, the lower portion of the upper holding member 30 is advanced toward the front of the hopper 101. As such, the lower holding member 32 can be properly contacted with the top face of the banknote present at the highest layer of the batch of the banknotes stored in the hopper 101.

Additionally, the holding member lift-up button 80 is provided to the top face of the banknote handling machine 100, and the controller 90 can control the lifting and lowering mechanism 35 to move the respective holding members 30, 32 to the waiting position, when the holding member lift-up button 80 is pushed by the user. With such configuration, the user can replenish the banknotes, optionally, at any time, by moving the respective holding members 30, 32 to the waiting position, when the user knows considerable reduction of the amount of the banknotes stored in the hopper 101, from observation of the amount thereof.

The invention claimed is:

1. A paper sheet holding apparatus, comprising:

a paper sheet storage unit adapted for storing therein a plurality of paper sheets in a stacked condition;

a paper sheet feeding mechanism located below the paper sheet storage unit and adapted for feeding each paper sheet present at the lowest layer of the plurality of paper sheets stored in the paper sheet storage unit, one by one;

a holding member, which is adapted for holding, from above, a batch of the paper sheets stored, in the stacked condition, in the paper sheet storage unit, and which is configured to be movable over a waiting position and a holding position, so that the holding member serves as a guide surface for guiding the batch of the paper sheets stored in the paper sheet storage unit, on the back side opposite to the front of the paper sheet storage unit, when the holding member is in the waiting position, while the holding member is in contact with a top face of the paper sheet present at the highest layer of the batch of the paper sheets stored in the paper sheet storage unit and serve to press the paper sheet downward, when the holding member is in the holding position; and a moving mechanism adapted for reciprocating the holding member between the waiting position and the holding position;

wherein as the holding member is moved by the moving mechanism from the waiting position, where the holding member is retracted and stored in a side plate on the back side of the paper sheet storage unit to the holding position, the holding member is moved downward as a lower portion of the holding member is advanced forward and away from the back side of the paper sheet storage unit.

2. The paper sheet holding apparatus according to claim 1, wherein the holding member has a guide plate that is used as the guide surface, when the holding member is in the waiting position, the position of the guide plate, when the holding member is in the waiting position, being on the back side of the paper sheet storage unit with respect to and higher than the position of the guide plate, when the holding member is in the holding position, and wherein the holding member is moved to gradually increase an angle of theoretical extended face of the guide plate relative to a bottom face of the paper sheet storage unit, the angle being positioned in an area above the bottom face of the paper sheet storage unit and on the back side of theoretical extended face of the guide plate, as the moving mechanism moves the holding member from the holding position to the waiting position.

3. The paper sheet holding apparatus according to claim 1, wherein the paper sheet storage amount detector is composed of an optical sensor, the optical sensor being provided in such a position that light horizontally emitted from the optical sensor travels outside a region in which the holding member is moved between the waiting position and the holding position, and wherein there is provided a controller which controls the moving mechanism to move the holding member to the waiting position, when the light horizontally emitted from the optical sensor is blocked by the paper sheets stored in the paper sheet storage unit.

4. The paper sheet holding apparatus according to claim 3, wherein the optical sensor is located at a height within a range of 50 to 70 mm from the bottom face of the paper sheet storage unit.

5. The paper sheet holding apparatus according to claim 1, wherein a holding member lift-up button is further provided, and wherein there is provided a controller which controls the moving mechanism to move the holding member to the waiting position, when the holding member lift-up button is pushed.

6. The paper sheet holding apparatus according to claim 5, wherein a paper sheet storage condition detector adapted for detecting that the paper sheets are stored in the paper sheet storage unit, and a holding position detector adapted for detecting that the holding member is in the holding position are further provided, respectively, and wherein the controller stops operation of the paper sheet feeding mechanism, when the holding member lift-up button is pushed, and then restarts the operation of the paper sheet feeding mechanism, when the paper sheet storage amount detector detects that the amount of the paper sheets stored in the paper sheet storage unit is greater than the preset amount, or when the paper sheet storage condition detector detects that the paper sheets are stored in the paper sheet storage unit, while the holding position detector detects that the holding member is in the holding position.

7. A paper sheet holding apparatus, comprising:

a paper sheet storage unit adapted for storing therein a plurality of paper sheets in a stacked condition;

a paper sheet feeding mechanism located below the paper sheet storage unit and adapted for feeding each paper sheet present at the lowest layer of the plurality of paper sheets stored in the paper sheet storage unit, one by one;

a holding member configured to be movable over a waiting position and a holding position, so that the holding member is in contact with a top face of the paper sheet present at the highest layer of the batch of the paper sheets stored in the paper sheet storage unit and serve to press the paper sheet downward, when the holding member is in the holding position;

a moving mechanism adapted for moving the holding member between the waiting position and the holding position;

a holding member lift-up button; and a controller configured to control the moving mechanism to move the holding member to the waiting position, when the holding member lift-up button is pushed;

wherein a paper sheet feed detector adapted for detecting that some failure occurs in the feeding operation for the paper sheets performed by the paper sheet feeding mechanism is further provided, and wherein, when the holding member lift-up button is pushed, the controller changes a period of time required for the detection of the failure in the feeding operation due to the paper sheet feed detector, into a longer one than the period of time employed in a normal operation.

8. A paper sheet holding apparatus, comprising:

a paper sheet storage unit adapted for storing therein a plurality of paper sheets in a stacked condition;

a paper sheet feeding mechanism located below the paper sheet storage unit and adapted for feeding each paper sheet present at the lowest layer of the plurality of paper sheets stored in the paper sheet storage unit, one by one; and a holding member configured to be movable over a waiting position and a holding position, so that the holding member serves as a guide surface for guiding the batch of the paper sheets stored in the paper sheet storage unit, on the back side opposite to the front of the paper sheet storage unit, when the holding member is in the waiting position, while the holding member is in contact with a top face of the paper sheet present at the highest layer of the batch of the paper sheets stored in the paper sheet storage unit and serve to press the paper sheet downward, when the holding member is in the holding position;

wherein a lower edge of the holding member when the holding member is in the waiting position, and an upper edge of a lower side plate, which is on the back side of the paper sheet storage unit and located below the holding member while being adjacent to the lower edge of the holding member, when the holding member is in the waiting position, are respectively comb-shaped to be fitted relative to each other.

9. The paper sheet holding apparatus according to claim 8, wherein an upper edge of the holding member when the holding member is in the waiting position, and a lower edge of an upper side plate, which is on the back side of the paper sheet storage unit and located above the holding member while being adjacent to the upper edge of the holding member, when the holding member is in the waiting position, are respectively comb-shaped to be fitted relative to each other.

10. The paper sheet holding apparatus according to claim 9, wherein the holding member can be moved downward, by hand, relative to the upper side plate on the back side of the paper sheet storage unit, even when the holding member is in the waiting position.

11. A paper sheet holding apparatus, comprising:

a paper sheet storage unit adapted for storing therein a plurality of paper sheets in a stacked condition;

a paper sheet feeding mechanism located below the paper sheet storage unit and adapted for feeding each paper sheet present at the lowest layer of the plurality of paper sheets stored in the paper sheet storage unit, one by one; and a holding member configured to be moveable over a waiting position and a holding position, so that the holding member is in contact with a top face of the paper sheet present at the highest layer of the batch of the paper sheets stored in the paper sheet storage unit and serve to press the paper sheet downward, when the holding member is in the holding position;

wherein an edge of the holding member in the direction of feeding the paper sheet, when the holding member is in the holding position, is comb-shaped, wherein the moveable mechanism is composed of a kicker roller adapted for kicking each paper sheet present at the lowest layer of the plurality of paper sheets stored in the paper sheet storage unit, one by one, and a feed roller adapted for feeding the paper sheets kicked by the kicker roller, one by one, to the outside of the paper sheet storage unit, and wherein, when the holding member is in the holding position, each projection of the comb-shape of the edge of the holding member is located above the kicker roller of the paper sheet feeding mechanism.

12. A paper sheet holding apparatus, comprising:

a paper sheet storage unit adapted for storing therein a plurality of paper sheets in a stacked position;

a paper sheet feeding mechanism located below the paper sheet storage unit and adapted for feeding each paper sheet present at the lowest layer of the plurality of paper sheets stored in the paper sheet storage unit, one by one;

a holding member, which is adapted for holding, from above, a batch of the paper sheet stored, in the stacked condition, on the paper sheet storage unit, and which is configured to be moveable over a waiting position and a holding position, so that the holding member is moved downward as a lower portion of the holding member is advanced forward and away from the back side of the paper sheet storage unit when the holding member is in the holding position, the holding member being retracted and eventually stored in a side plate on the back side of the paper sheet storage unit in such a manner that a portion on the back side of the holding member moves at the forefront, from a state in which the holding member is advanced forward, as the holding member is moved from the holding position to the waiting position.

13. A paper sheet holding apparatus, comprising:

a paper sheet storage unit adapted for storing therein a plurality of paper sheets in a stacked condition;

a paper sheet feeding mechanism located below the paper sheet storage unit and adapted for feeding each paper sheet present at the lowest layer of the plurality of paper sheets stored in the paper sheet storage unit, one by one; and a holding member, which is adapted for holding, from above, a batch of the paper sheet stored, in the stacked condition, in the paper sheet storage unit, and which is configured to be moveable over a waiting position and a holding position, the holding member is moved downward as a lower portion of the holding member is advanced forward and away from the back side of the paper sheet storage unit, so that the holding member serves as a guide surface for guiding the batch of the paper sheets stored in the paper sheet storage unit, on the back side opposite to the front of the paper sheet storage unit, when the holding member is in the waiting position, while the holding member is in contact with a top face of the paper sheet present at the highest layer of the batch of the paper sheet stored in the paper sheet storage unit and serve to press the paper sheet downward, when the holding member is in the holding position; and wherein a lower portion of the holding member when the holding member is in the waiting position is positioned on an upstream side of the direction of feeding the paper sheet, when the holding member is in the holding position.

14. The paper sheet holding apparatus according to claim 13, wherein the holding member has a guide plate that is used as the guide surface and the holding member is moved to gradually increase an angle of theoretical extended face of the guide plate relative to a bottom face of the paper sheet storage unit, the angle being positioned in an area above the bottom face of the paper sheet storage unit and on the back side of theoretical extended face of the guide plate, as the holding member is moved from the holding position to the waiting position.

* * * * *

UNITED STATES PATENT AND TRADEMARK OFFICE

CERTIFICATE OF CORRECTION

PATENT NO. : 8,210,523 B2
APPLICATION NO. : 12/449203
DATED : July 3, 2012
INVENTOR(S) : Kouichi Maekawa et al.

It is certified that error appears in the above-identified patent and that said Letters Patent is hereby corrected as shown below:

IN THE CLAIMS:

Column 20, line 39, claim 12: the word "on" should be replaced with the word "in"

Column 20, lines 41 through 44, claim 12:
- after "holding member is" - add the words: "advanced forward"
- remove the words: "moved downward as a lower portion of the holding member is advanced forward and away from the back side of the paper sheet storage unit"

Column 20, line 61, claim 13: the word "sheet" should be replaced with "sheets"

Column 20, lines 64 through 67, claim 13:
- after the words "holding position," - add "so that"
- after the words "the holding member":
  - delete the words - "is moved downward as a lower portion of the holding member is advanced forward and away from the back side of the paper sheet storage unit, so that the holding member"

Column 21, line 7, claim 13: the word "sheet" should be replaced with "sheets"

Column 22, lines 2 through 3, claim 14:
- replace the number "13" with the number "12"
- after the words "holding member":
  - delete the words: "has a guide plate that is used as the guide surface and the holding member"

In Column 22, line 11, claim 15:
The following claim should be added:
15. The paper sheet holding apparatus according to claim 14, wherein the holding member is moved to gradually increase an angle of theoretical extended face of the guide plate relative to a bottom face of the paper sheet storage unit, the angle being positioned in an area above the bottom face of the paper Signed and Sealed this
Twenty-first Day of August, 2012

David J. Kappos
*Director of the United States Patent and Trademark Office* sheet storage unit and on the back side of theoretical extended face of the guide plate, as the holding member is moved from the holding position to the waiting position.

UNITED STATES PATENT AND TRADEMARK OFFICE

CERTIFICATE OF CORRECTION

PATENT NO. : 8,210,523 B2
APPLICATION NO. : 12/449203
DATED : July 3, 2012
INVENTOR(S) : Kouichi Maekawa et al.

It is certified that error appears in the above-identified patent and that said Letters Patent is hereby corrected as shown below:

Delete title page and substitute therefore the attached title page showing the corrected number of claims in patent.

IN THE CLAIMS:

Column 20, line 39, claim 12: the word "on" should be replaced with the word "in"

Column 20, lines 41 through 44, claim 12:
- after "holding member is" - add the words: "advanced forward"
- remove the words: "moved downward as a lower portion of the holding member is advanced forward and away from the back side of the paper sheet storage unit"

Column 20, line 61, claim 13: the word "sheet" should be replaced with "sheets"

Column 20, lines 64 through 67, claim 13:
- after the words "holding position," - add "so that"
- after the words "the holding member":
  - delete the words - "is moved downward as a lower portion of the holding member is advanced forward and away from the back side of the paper sheet storage unit, so that the holding member"

Column 21, line 7, claim 13: the word "sheet" should be replaced with "sheets"

Column 22, lines 2 through 3, claim 14:
- replace the number "13" with the number "12"
- after the words "holding member":
  - delete the words: "has a guide plate that is used as the guide surface and the holding member"

This certificate supersedes the Certificate of Correction issued August 21, 2012.

Signed and Sealed this
Eleventh Day of September, 2012

David J. Kappos

David J. Kappos
*Director of the United States Patent and Trademark Office*

In Column 22, line 11, claim 15:
The following claim should be added:
15. The paper sheet holding apparatus according to claim 14, wherein the holding member is moved to gradually increase an angle of theoretical extended face of the guide plate relative to a bottom face of the paper sheet storage unit, the angle being positioned in an area above the bottom face of the paper sheet storage unit and on the back side of theoretical extended face of the guide plate, as the holding member is moved from the holding position to the waiting position.

(12) United States Patent
Maekawa et al.

(10) Patent No.: US 8,210,523 B2
(45) Date of Patent: Jul. 3, 2012

(54) PAPER SHEET HOLDING APPARATUS

(75) Inventors: Kouichi Maekawa, Tokyo-To (JP); Osamu Ito, Kawaguchi (JP); Hidehiko Matsushita, Takasago (JP); Fumiaki Koga, Tokyo-To (JP)

(73) Assignee: Glory Ltd., Hyogo-Ken (JP)

( * ) Notice: Subject to any disclaimer, the term of this patent is extended or adjusted under 35 U.S.C. 154(b) by 286 days.

(21) Appl. No.: 12/449,203

(22) PCT Filed: Feb. 8, 2007

(86) PCT No.: PCT/JP2007/052188

§ 371 (c)(1),
(2), (4) Date: Jul. 28, 2009

(87) PCT Pub. No.: WO2008/096428

PCT Pub. Date: Aug. 14, 2008

(65) Prior Publication Data

US 2010/0117294 A1 May 13, 2010

(51) Int. Cl.
*B65H 1/08* (2006.01)

(52) U.S. Cl. ..... 271/126; 271/160; 271/165

(58) Field of Classification Search ..... 271/126, 271/157, 160, 165

See application file for complete search history.

(56) References Cited

U.S. PATENT DOCUMENTS 4,971,310 A * 11/1990 Motegi et al. ..... 271/126
5,967,504 A * 10/1999 Yankloski ..... 271/2

FOREIGN PATENT DOCUMENTS

JP 63-88636 6/1988
JP 03-095033 4/1991
JP 2005-212910 8/2005
JP 2006-027776 2/2006

* cited by examiner

*Primary Examiner* – Kaitlin Joerger

(74) *Attorney, Agent, or Firm* – Renner, Kenner, Greive, Bobak, Taylor & Weber

(57) ABSTRACT

A paper sheet storage unit 101 is opened upward and forward. Holding members 30, 32 are respectively configured to be reciprocated, between a waiting position and a holding position, by a lifting and lowering mechanism 35. When the respective holding members 30, 32 are in the waiting position, such holding members 30, 32 can serve as a guide surface, on the back side of the paper sheet storage unit 101, for guiding a batch of paper sheets stored in the paper sheet storage unit 101. Meanwhile, when the respective holding members 30, 32 are in the holding position, the holding member 32 is in contact with a top face of the paper sheet present at the lowest layer of the paper sheets stored in the paper sheet storage unit 101, and serves to press the paper sheet downward. A controller 90 controls the lifting and lowering mechanism 35, such that the lifting and lowering mechanism 35 moves the holding members 30, 32 to the waiting position, when a paper sheet storage amount detector 74 detects that the amount of the paper sheets stored in the paper sheet storage unit 101 is greater than a preset amount, while the lifting and lowering mechanism 35 moves the holding members 30, 32 to the holding position, when the paper sheet storage amount detector 74 detects that the amount of the paper sheets stored in the paper sheet storage unit 101 is less than the preset amount.

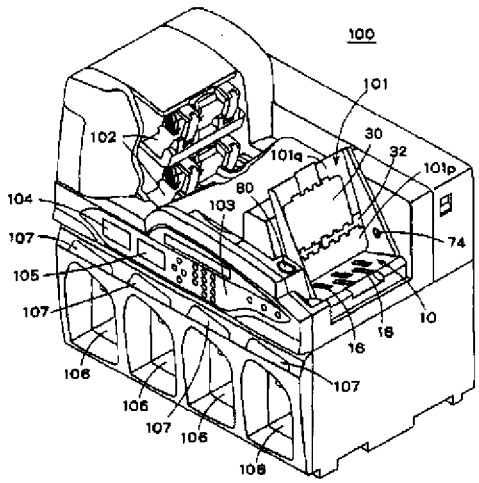

15 Claims, 7 Drawing Sheets